US008020964B2

(12) United States Patent
Sugahara

(10) Patent No.: US 8,020,964 B2
(45) Date of Patent: Sep. 20, 2011

(54) LIQUID DROP EJECTING DEVICE AND METHOD FOR MANUFACTURING SAME

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 365 days.

(21) Appl. No.: 12/413,063

(22) Filed: Mar. 27, 2009

(65) Prior Publication Data

US 2009/0244179 A1 Oct. 1, 2009

(30) Foreign Application Priority Data

Mar. 31, 2008 (JP) ..... 2008-091652

(51) Int. Cl.
*B41J 2/15* (2006.01)

(52) U.S. Cl. ..... 347/40

(58) Field of Classification Search ..... 347/20, 347/40–43

See application file for complete search history.

(56) References Cited

U.S. PATENT DOCUMENTS

| | | | | |
|---|---|---|---|---|
| 6,378,982 | B2 * | 4/2002 | Ono et al. | 347/41 |
| 6,793,319 | B2 * | 9/2004 | Ikemoto et al. | 347/40 |
| 2005/0179724 | A1 | 8/2005 | Salt et al. | |
| 2005/0270339 | A1 | 12/2005 | Sugahara | |

FOREIGN PATENT DOCUMENTS

| | | | |
|---|---|---|---|
| JP | 2002-019103 | A | 1/2002 |
| JP | 2004-209655 | A | 7/2004 |
| JP | 2004-276487 | A | 10/2004 |
| JP | 2005-515101 | T | 5/2005 |
| JP | 2005-138526 | A | 6/2005 |
| JP | 2005-225098 | A | 8/2005 |
| JP | 2005-349568 | A | 12/2005 |
| JP | 2006-082344 | A | 3/2006 |
| JP | 2007-055107 | A | 3/2007 |
| JP | 2007-283552 | A | 11/2007 |
| JP | 2008-023915 | A | 2/2008 |

OTHER PUBLICATIONS

Japan Patent Office, Notice of Reasons for Rejection in counterpart Patent Application No. JP 2008-091652, mailed May 25, 2010.

* cited by examiner

*Primary Examiner* — An Do
(74) *Attorney, Agent, or Firm* — Baker Botts L.L.P.

(57) ABSTRACT

A liquid drop ejecting device includes a housing supporting a plurality of head units that are arranged in two rows to be partially overlapping along a main scanning direction in a staggered configuration. The head unit includes a flow path unit having an ink flow path, a piezoelectric actuator ejecting ink from nozzles in the flow path unit, and a reinforcement plate for reinforcing the flow path unit. In the reinforcement plate, a smaller-width portion and a larger-width portion are disposed along the main scanning direction, such that an end face of the smaller-width portion of the reinforcement member in one row contacts an end face of a reinforcement member in the adjacent row.

12 Claims, 13 Drawing Sheets

LIQUID DROP EJECTING DEVICE AND METHOD FOR MANUFACTURING SAME

CROSS-REFERENCE TO RELATED APPLICATIONS

The present application claims priority to and the benefit of Japanese Patent Application No. 2008-091652, which was filed on Mar. 31, 2008, the disclosure of which is incorporated herein by reference in its entirety.

BACKGROUND OF THE INVENTION

1. Field of the Invention

The present invention relates to a liquid drop ejecting device of a printer apparatus ejecting liquid drops from nozzles formed in head units, and a method for manufacturing for the same.

2. Description of the Related Art

Patent Application Publication No. JP 2005-349568 A discloses an ink jet head including a flow path unit wherein a piezoelectric actuator stacked on the top surface of a flow path unit. If the ink jet head has low rigidity, the path of ink ejected from nozzles of the flow path unit may not reach its intended target. Accordingly, in order to increase its rigidity, such an ink jet head includes a reinforcement member having a thickness greater than that of the ink jet head. In this case, the reinforcement member for the head unit extends around the entire periphery of the ink jet head, and that it further projects from the ink jet head in order to be fixed to a housing of the ink jet head.

In order to increase the yield of ink ejection of a printer apparatus, a line-type ink jet head is provided with a plurality of such head units. In this case, long nozzle rows are equidistantly arranged in one direction, and head units are arranged in a plurality of rows in a staggered configuration along the same direction.

Nevertheless, if the head units are arranged in a staggered configuration along one direction, adjacent projecting portions of the reinforcement member may interfere with each other in a direction perpendicular to the one direction, which would undesirably enlarge the size of the ink jet head, and, thus, the corresponding printer apparatus.

SUMMARY OF THE INVENTION

Accordingly, the present invention is directed to providing a liquid drop ejecting device with an increased density of head units without underably enlarging the size of the device, and a manufacturing method for the same.

A liquid drop ejecting device according to an embodiment of the invention includes a first head unit row having a plurality of head units arranged along a scanning direction, each head unit in the first head unit row has a first overlapping portion; and a second head unit row having a plurality of head units arranged along the scanning direction, each head unit in the second head unit row has a second overlapping portion, the first head unit row is adjacent to the second head unit row. The first row head units are arranged in a staggered configuration relative to the second row head units, the first overlapping portion of each first row head unit overlaps the second overlapping portion of the adjacent second row head unit along the scanning direction. Each of the head units includes a flow path structure including a liquid path with a plurality of nozzles that are equidistantly arranged along the scanning direction; and a reinforcement member coupled to the flow path structure and substantially parallel to a liquid drop ejecting surface to which the plurality of nozzles are opened. The reinforcement member includes a projecting portion extending in a conveying direction perpendicular to the scanning direction, the projecting portion forms a larger-width portion of a first width, the larger-width portion including a first end face extending along the scanning direction; and at least one smaller-width portion of a second width adjacent to the larger-width portion along the scanning direction, the at least one smaller-width portion including a second end face, and the first width is greater than the second width along the conveying direction. The first overlapping portions includes the projecting portions of the first row head units. Each of the first row head units is arranged, such that a portion of the second end face of the first row head unit is closer to the first end face and the second end face of the adjacent second row head unit than the corresponding first end face of the first row head unit.

A method for manufacturing a liquid drop ejecting device according to an embodiment of the invention includes the step of manufacturing a head unit including a flow path structure, by providing a liquid path including a plurality of nozzles that are equidistantly arranged along a scanning direction, the nozzles opening to a liquid drop ejecting surface. Providing a reinforcement member having a projecting portion extending in a conveying direction perpendicular to the particular direction, the projecting portion forming a larger-width portion of a first width, the larger-width portion including a first end face extending along the scanning direction, the reinforcement member having at least one smaller-width portion of a second width adjacent to the larger-width portion along the scanning direction, the at least one smaller-width portion including a second end face, and the first width is greater than the second width along the conveying direction. Coupling the reinforcement member to the flow path structure so as to project from both sides the head units in the conveying direction and parallel with the a liquid drop ejecting surface. Installing a plurality of the head units in a first head unit row and a second head unit row extending along the scanning direction. The first row head units are installed in a staggered configuration relative to the second row head units whereby the first row head units partially overlap the second row head units along the scanning direction, and the first head unit row is adjacent to the second head unit row in the conveying direction. The installing step comprises bringing the at least one second end face of the first row head units into contact with the first end face or second end face of an adjacent second row head unit in the further direction.

Other objects, features, and advantages will be apparent to persons of ordinary skill in the art in view of the following detailed description of the invention and the accompanying drawings.

BRIEF DESCRIPTION OF THE DRAWINGS

For a more complete understanding of the invention, reference now is made to the following descriptions taken in connection with the accompanying drawings.

DETAILED DESCRIPTION OF EMBODIMENTS

Exemplary embodiments of the present invention may be understood by referring to FIGS. 1-13, like numerals being used for like corresponding parts in the various drawings.

Figure 1:
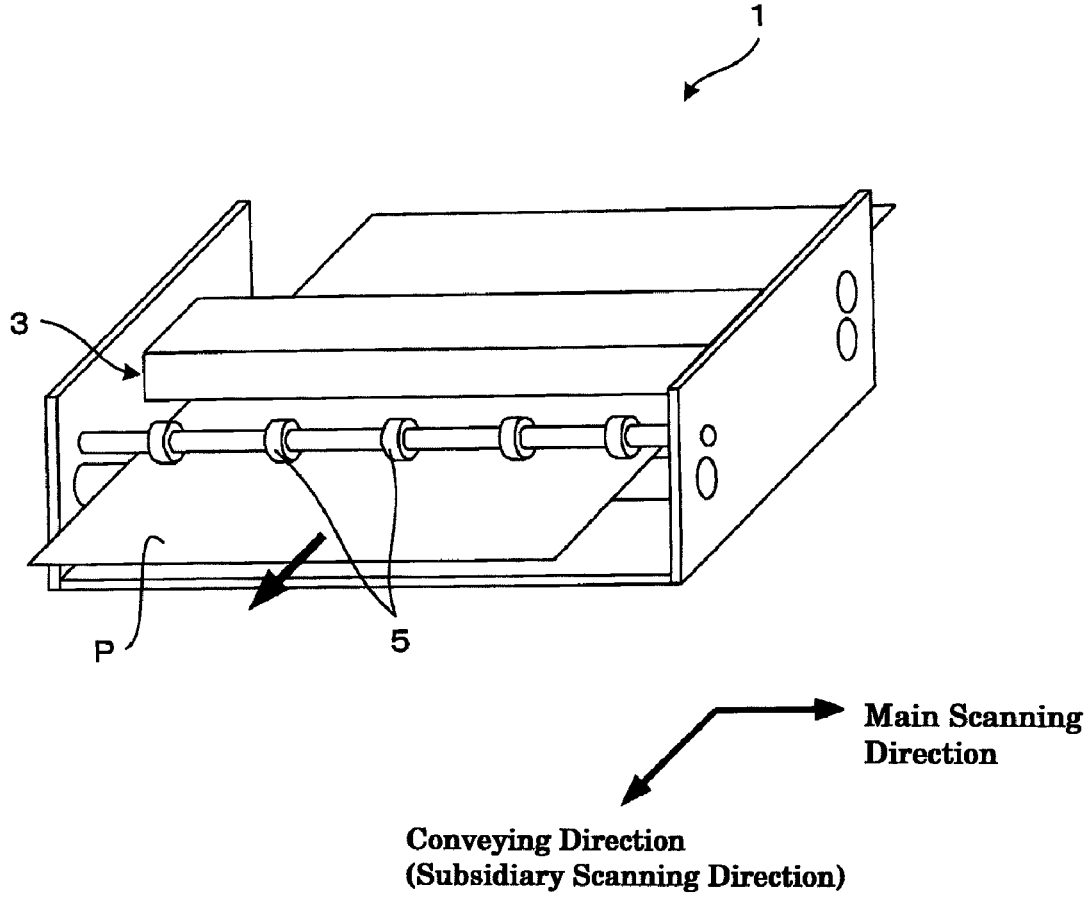
FIG. 1 is a perspective view an ink jet printer apparatus according to an embodiment of the present invention.

An ink jet printer according to an embodiment of the present invention is a printer apparatus equipped with a line-type, ink jet head including a plurality of head units. As shown in FIG. 1, an ink jet printer 1 (e.g., a liquid drop ejecting device) includes a line-type, ink jet head 3 that may extend in a right-and-left direction (e.g., a main scanning direction) and that may eject ink onto recording paper P, and a conveying roller 5 that may convey recording paper P in a conveying direction illustrated by the arrow. Ink jet printer 1 may be configured to cause ink jet head 3 to eject ink onto the recording paper P, and simultaneously, to cause conveying roller 5 to convey recording paper P in the conveying direction, to thereby record desired images or letters onto recording paper P.

Figure 2:
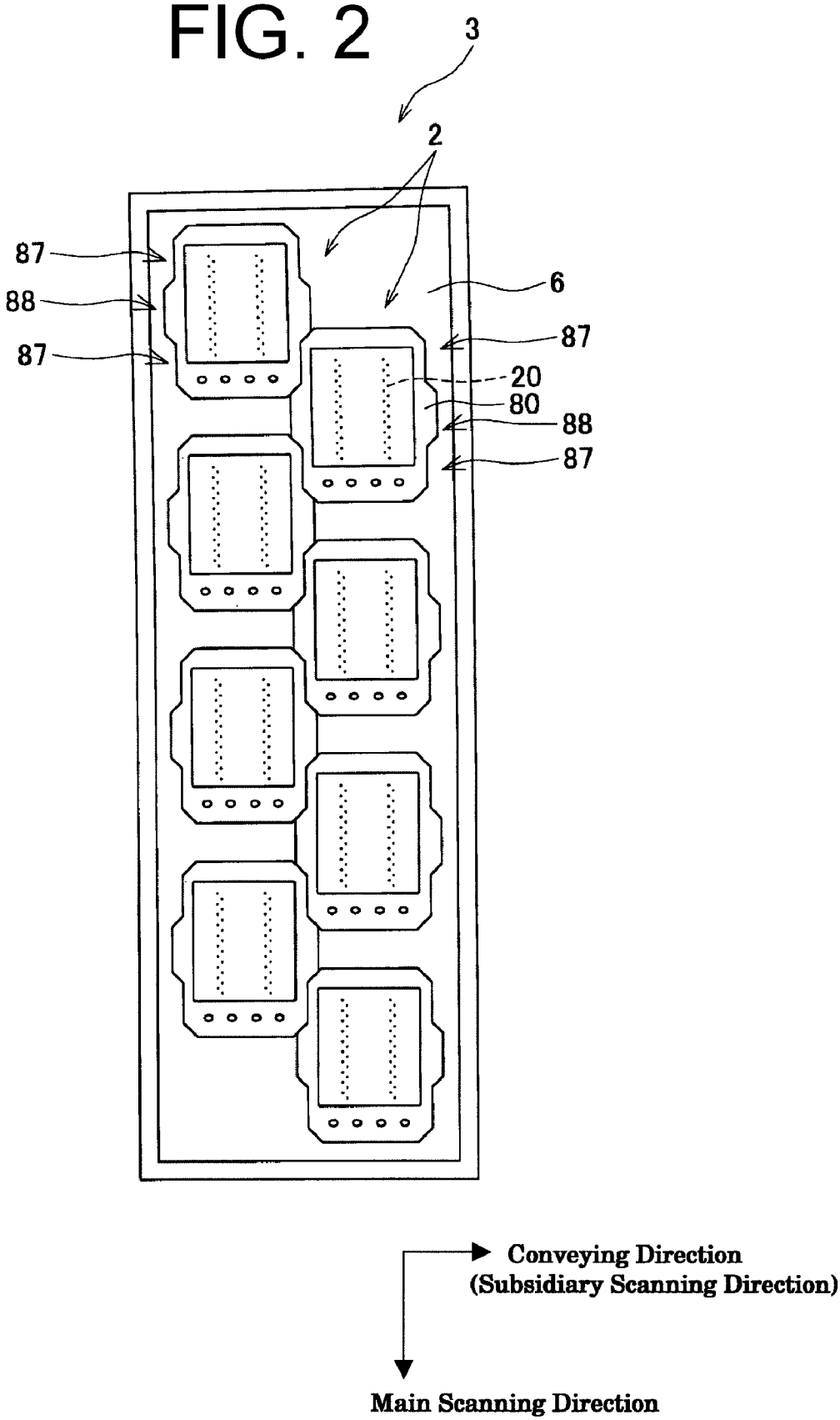
FIG. 2 is a plan view of an ink jet head as viewed from above.
Figure 3:
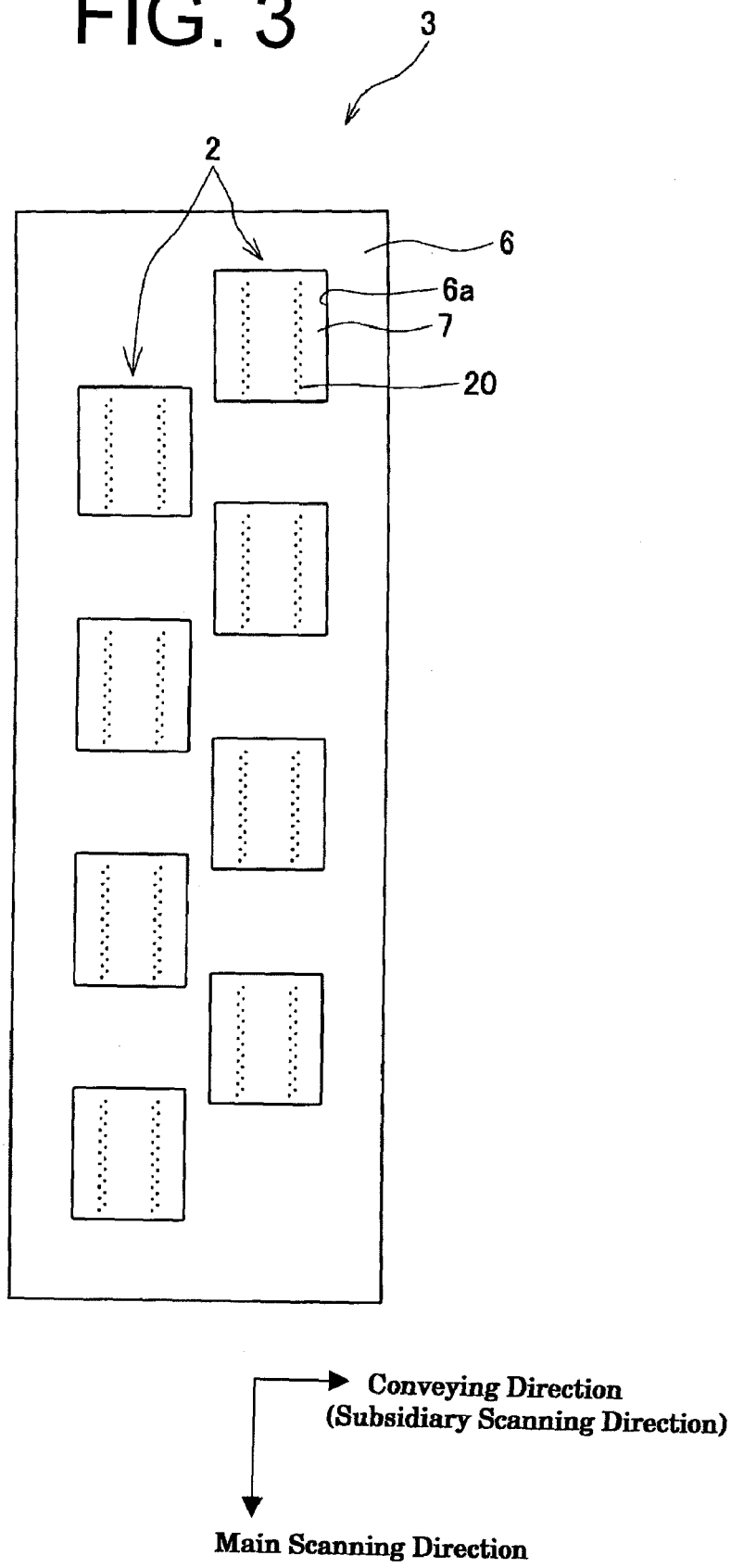
FIG. 3 is a plan view of the ink jet head as viewed from below.

As shown in FIGS. 2 and 3, ink jet head 3 may include a plurality of head units 2 arranged in two rows along the main scanning direction in a staggered configuration, and a housing 6 supporting the plurality of head units 2.

Housing 6 may be fixed to a casing of the printer, such that the recording paper P to be conveyed by the conveying roller 5 may be parallel with ink ejecting surfaces 7 (e.g., liquid drop ejecting surfaces) of the plurality of head units 2. Housing 6 also may include a plurality of openings 6*a* corresponding to installation positions of the plurality of head units 2, and each of openings 6*a* accommodates a flow path unit 4 (described below) of each head unit 2. The bottom surface of housing 6 may be flush with ink ejecting surface 7.

As shown in FIGS. 4-7, each of the head units 2 may include a flow path unit 4 with a discrete ink flow path 22 including a nozzle 20 and a pressure chamber 14. A piezoelectric actuator 50 may pressurize ink in pressure chamber 14 to eject ink from nozzle 20. A reinforcement plate 80 may reinforce flow path unit 4.

Flow path unit 4 may include a cavity plate 10, a base plate 11, and a manifold plate 12, formed of a metal material, such as stainless steel, and a nozzle plate 13, formed of an insulating material, for example, a polymer synthetic resin material such as polyimide. These four plates 10 to 13 may be joined to one another in a stacked configuration.

Figure 4:
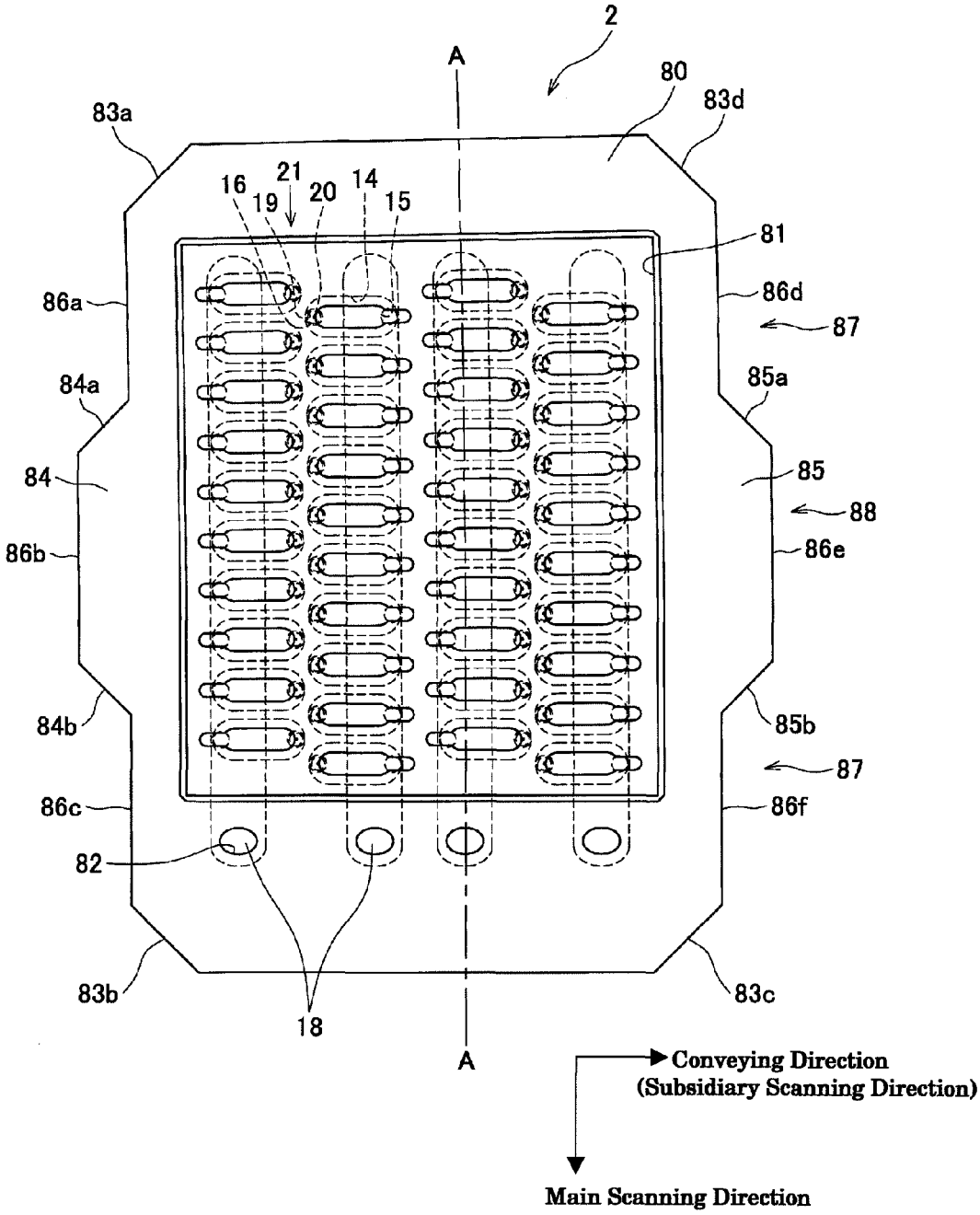
FIG. 4 is a plan view of a head unit.
Figure 5:
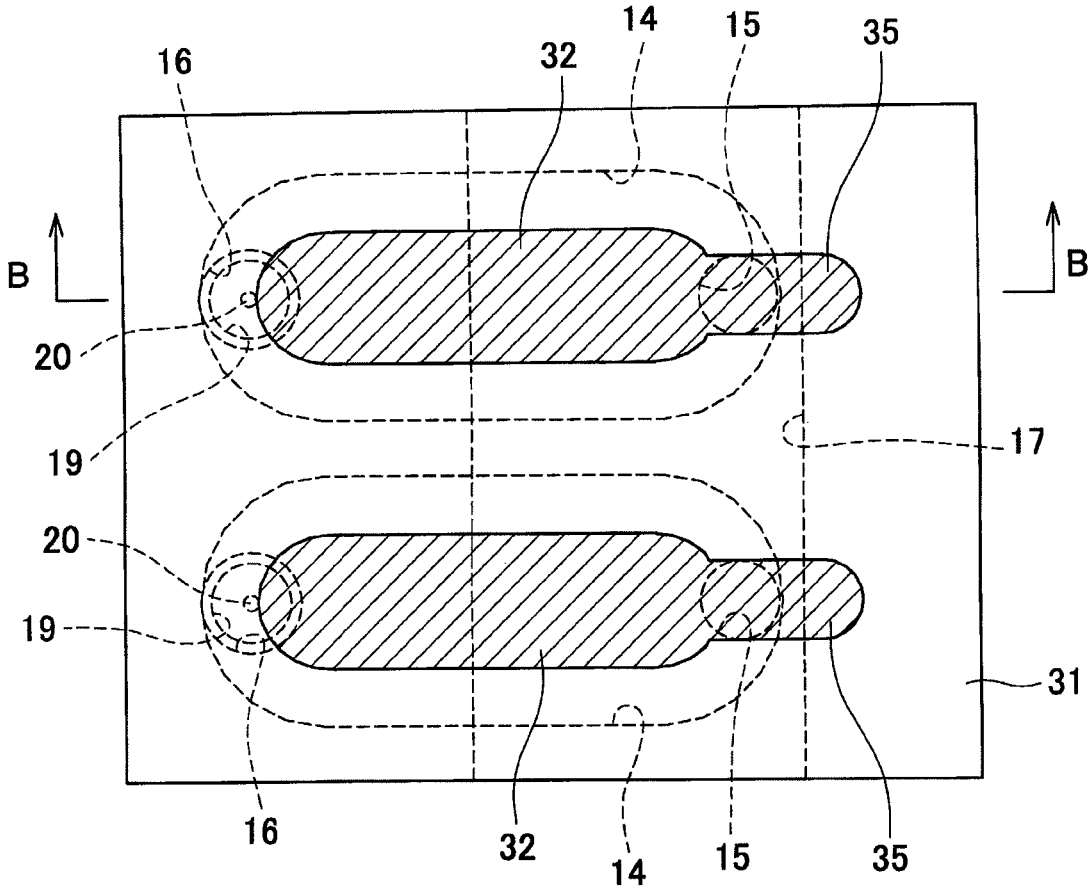
FIG. 5 is a partially enlarged view of FIG. 4.

Nozzle plate 13 may include a plurality of penetrating nozzles. The plurality of nozzles 20 may be arranged along the main scanning direction to form a nozzle row 21. FIG. 4 shows that four of such nozzle rows 21 may be arranged side by side in a conveying direction, from each of nozzle rows 21, and black, yellow, cyan, and magenta inks may be ejected respectively. Ink ejecting surface 7 may be formed by the bottom surface of the nozzle plate 13 at which the plurality of nozzles 20 are disposed.

In cavity plate 10, each of pressure chambers 14 may be in fluid communication with a corresponding nozzle 20. Pressure chambers 14 may have a substantially elliptical shape extending in conveying direction, so that one end overlaps nozzle 20 in a plan view. In base plate 11, through holes 15 and 16 may be provided at positions overlapping both ends of the pressure chamber 14 in the conveying direction in a plan view.

Manifold plate 12 may include manifold flow paths 17 corresponding to each of respective nozzle rows 21. Each of manifold flow paths 17 may extend in the main scanning direction in a position spaced apart from nozzles 20 of a corresponding nozzle row 21 in the conveying direction, and further overlaps in a plan view about one-half of each of pressure chambers 14 in a corresponding nozzle row 21. One end of manifold flow path 17 may fluidly communicate with a respective ink supply port 18 formed in a top layer of cavity plate 10. Ink supply ports 18 may be connected to respective four ink tanks (not shown), from which inks may be supplied through ink supply ports 18 to manifold flow paths 17. Through holes 19 may be formed in the manifold plate 12, each of which is located in a position overlapping in a plan view both through hole 16 of base plate 11 and nozzle 20 of nozzle plate 13.

Figure 6:
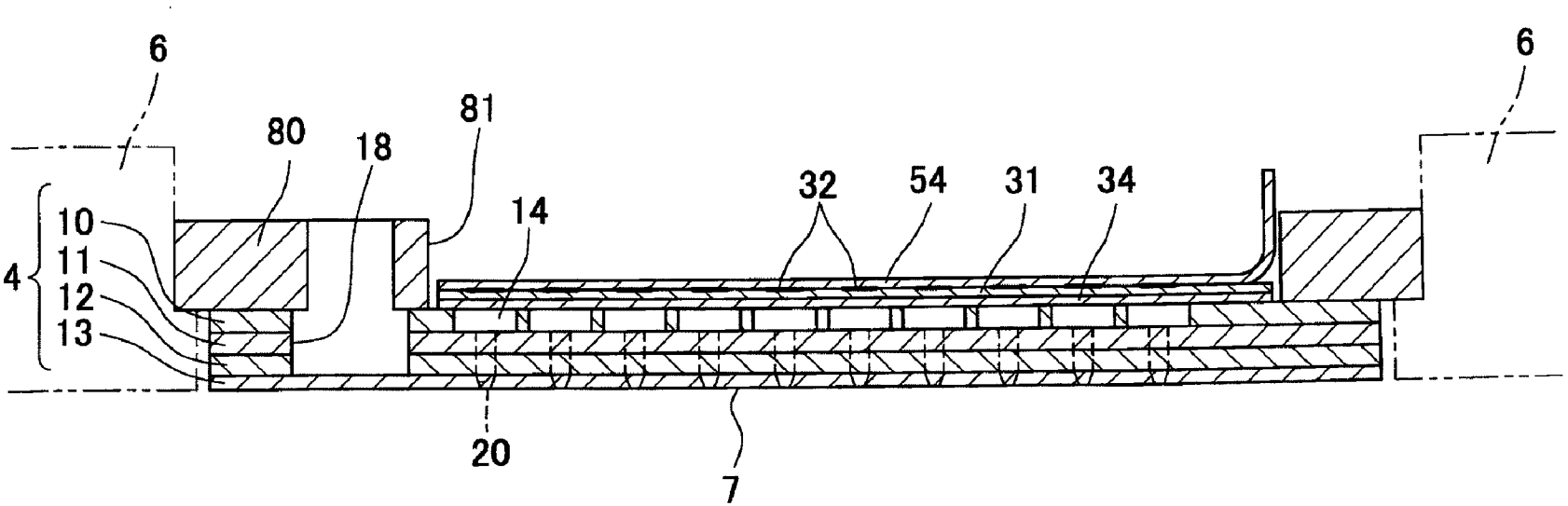
FIG. 6 is a sectional view along line A-A in FIG. 4.
Figure 7:
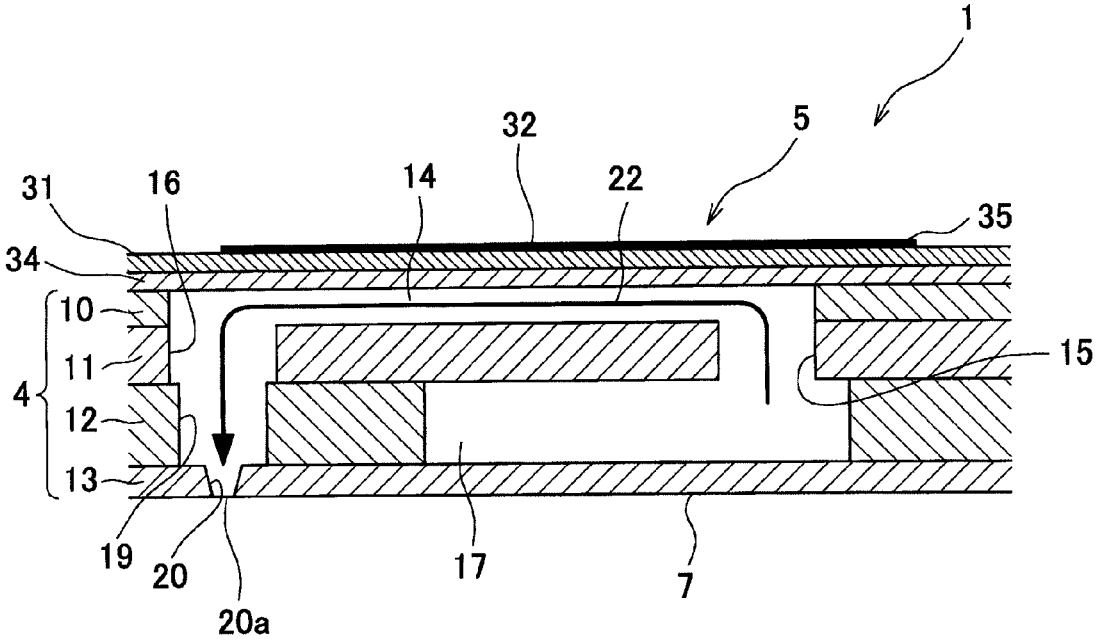
FIG. 7 is a sectional view along line B-B in FIG. 5.

Thus, in the flow path unit 4, as shown in FIGS. 6-7, manifold flow path 17 may communicate fluidly with ink supply port 18, which may communicate fluidly with pressure chamber 14 via through hole 15. Pressure chamber 14 further may communicate fluidly with nozzle 20 via through holes 16 and 19. Consequently, flow path unit 4 may include a plurality of discrete ink flow paths 22 that are independent of one another and each of which leads to nozzle 20 from an exit of manifold flow path 17 via pressure chamber 14.

Piezoelectric actuator 50 may include a diaphragm 34, a piezoelectric layer 31, and a plurality of discrete electrodes 32. Diaphragm 34 may be formed of a conductive material such as a metal, and may be joined onto a top surface of cavity plate 10 to cover the plurality of pressure chambers 14. Diaphragm 34, which may be conductive, may also serve as a common electrode for applying an electric field to portions of actuator 50 arranged between the plurality of discrete electrodes 32. Diaphragm 34 also may be connected to ground wiring and maintained at ground potential.

Piezoelectric layer 31 may be a mixed crystal of lead titanate and lead zirconate, and may be formed of a piezoelectric material containing lead zirconate titanate (PZT) having ferroelectric properties. Piezoelectric layer 31 may be arranged continuously over the top surface of the diaphragm 34 across the plurality of the pressure chambers 14. In addition, piezoelectric layer 31 may be polarized in its thickness direction.

The plurality of discrete electrodes 32 may be disposed on the top surface of piezoelectric layer 31 to correspond with the plurality of pressure chambers 14. Corresponding discrete electrode 32 may have a substantially elliptical planar shape slightly smaller than its corresponding pressure chamber 14, and may be disposed in a position substantially overlapping a central portion of pressure chamber 14 in a plan view. Moreover, one end of discrete electrode 32 may extend beyond the pressure chamber 14 in a plan view, and terminate at contact point 35 that may be connected to an end of a flexible printed circuit (FPC) board 54. The other end of FPC board 54 may be connected to a drive circuit (not shown) configured to selectively apply either a predetermined drive potential or the ground potential to discrete electrode 32 via FPC board 54.

An operation of piezoelectric actuator 50 is described below. When a pressure is not applied to ink by diaphragm 34, the potentials of the plurality of discrete electrodes 32 may be held at the ground potential. In this state, when the predetermined drive potential may be applied to some of the plurality of discrete electrodes 32, a potential difference may occur between discrete electrode 32 supplied with the drive potential and diaphragm 34 serving as a common electrode held at the ground potential. As a result, in a portion of actuator 50 sandwiched between discrete electrode 32 in piezoelectric layer 31 and diaphragm 34, an electric field may occur in its thickness direction. If the polarization direction of piezoelectric layer 31 and a direction of the electric field are the same, the piezoelectric layer 31 may extend in its thickness direction and may contract in its surface direction. As a result of this contraction deformation, a portion of the diaphragm 34, opposite to the pressure chamber 14 may deform so as to be convex toward the pressure chamber 14 side (e.g., unimorph deformation). At this time, because the volume of the pressure chamber 14 decreases, the pressure of ink therewithin increases, and ink drops may be ejected from nozzle 20 in fluid communication with pressure chamber 14.

As shown in FIGS. 4 and 6, a reinforcement plate 80 may be formed of a metal material such as stainless steel, and may be sufficiently greater in thickness and higher in rigidity than flow path unit 4. Reinforcement plate 80 may have a substantially rectangular shape that is larger than the external shape of flow path unit 4, in a plan view. An opening 81 may be disposed in central portion of reinforcement plate 80 to accommodate piezoelectric actuator 50, opening 81 may have a rectangular shape slightly larger than the external shape of piezoelectric actuator 50 in a plan view. In addition, one end of reinforcement plate 80 may include openings 82 that overlap ink supply ports 18 in a plan view. Reinforcement plate 80 may be parallel with ink ejecting surface 7, and joined to the top surface of cavity plate 10 when piezoelectric actuator 50 is located in the opening 81. Reinforcement plate 80 may reinforce flow path unit 4 to prevent the direction of ink ejecting from the nozzle from deviating from its intended target due to warping of flow path unit 4 or the like.

The four corners of reinforcement plate 80 may be chamfered at an inclination angle, between 0-90 degrees relative to the main scanning direction to form oblique lines 83*a* to 83*d*, which are shown as about 45 degrees in this embodiment. On either side of reinforcement plate 80, trapezoidal convex portions 84 and 86 may project outwardly along the conveying direction. Each of oblique lines 84*a*, 84*b*, 85*a*, and 85*b* of convex portions 84 and 85 may have an obtuse angle shape, such that each is inclined between 0-90 degrees relative to the main scanning direction, which is shown in this embodiment to be 45 degrees. Consequently, oblique lines 83*a*, 83*c*, 84*a*, and 85*b* may be parallel with one another, while oblique lines 83*b*, 83*d*, 84*b*, and 85*a* may be parallel with one another. Sides 86*a* to 86*f* may be parallel along the main scanning direction, i.e., arrangement direction of nozzles 20, in row 21.

Regarding the shape of reinforcement plate 80, because both ends of reinforcement plate 80 in the main scanning direction may not include convex portions 84 and 85 projecting outwardly, the ends constitute smaller-width portions 87. Because the central portion of reinforcement plate 80 may include the convex portions 84 and 85 projecting outwardly, the central portion may form a larger-width portion 88 that is wider in the conveying direction than each of smaller-width portions 87. Larger-width portion 88 may be located at a position overlapping ink ejecting surface 7. Thus, smaller-width portions 87 and larger-width portion 88 may be arranged consecutively in the order of smaller-width portion 87, larger-width portion 88, and smaller-width portion 87, along the main scanning direction. The shape of a boundary portion forming smaller-width portion 87 and larger-width portion 88, which in this embodiment, for example, a shape from side 86*a* up to the side 86*b* via oblique line 84*a*, may be an obtuse angle shape, so that reinforcement plate 80 can be easily molded by a simple method such as press work. Also, because reinforcement plate 80 may be provided with larger-width portion 88, reinforcement plate 80 may be carried easily by its larger-width portion 88 during manufacturing.

Flow path unit 4 and piezoelectric actuator 50 may be mounted on the above-described reinforcement plate 80 to form head unit 2. As shown in FIG. 2, in the plurality of head units 2, ink supply ports 18 may be located at an end of ink flow manifolds 17 in fluid communication with nozzle rows 21 arranged along the main scanning direction, flow path units 4 may be positioned within the plurality of openings 6*a* in housing 6, and the bottom surfaces of reinforcement plates 80 may be fixed onto the top surface of housing 6.

As shown in FIG. 2, in two adjacent reinforcement plates 80 that belong to mutually different nozzle rows 21, adjacent end faces of smaller-width portions 87 in the conveying direction may be in contact with each other. More specifically, end faces forming oblique lines 83*c* and 85*b*, and the side 86*f* of a reinforcement plate 80 in the left nozzle row may be in contact with end faces forming oblique lines 83*a* and 84*a*, and side 86*a* of a reinforcement plate 80 belonging to the right nozzle row. Thus, end faces forming oblique lines 83*d* and 85*a*, and side 86*d* of a reinforcement plate 80 belonging to the left nozzle row may be in contact with end faces forming oblique lines 83*b* and 84*b*, and side 86*c* of a reinforcement plate 80 belonging to the right row.

Between end faces of reinforcement plates 80 contacting each other, there may be a minute gap provided to serve as an adjustment margin for performing alignment in the main scanning direction of reinforcement plates 80. By this adjustment margin, the position of reinforcement plate 80 in the main scanning direction may be adjusted, so that the distance between adjacent nozzles 20 along the main scanning direction in one nozzle row 21 in one head unit 2 may be equal to the distance between adjacent nozzles 20 in another nozzle row 21 located at a position closest to the above-described one nozzle row along the main scanning direction in an adjacent head unit 2. Consequently, when a group of the plurality of head units 2 arranged in the staggered configuration for an ink jet head 3 of a line-type, liquid drop ejecting device, adjacent nozzles 20 may be arranged equidistantly in the main scanning direction. At this time, because sides 86*a*, 86*c*, 86*d*, and 86*f* of the smaller-width portion 87 of one reinforcement plate 80 may be in contact with other adjacent reinforcement plates 80 and parallel with the nozzle arrangement direction, it may be sufficient to adjust only the main scanning direction position without the need for concerning about positional deviation in the conveying direction of reinforcement plate 80. The position of each of reinforcement plates 80 may be adjusted along the main scanning direction, and two adjacent reinforcement plates 80 may be fixed to each other by injecting an adhesive constituted of light curable resin into the above-described gap.

Because each of the reinforcement plates 80 may be joined to one another adjacent reinforcement plate 80 with adhesive, such that oblique lines, of the bent-shaped end faces engage one another, the joining force is greater than where the reinforcement plates are joined merely at linear end faces.

According to the above-described ink jet printer 1, the plurality of head units 2 may be arranged in the staggered configuration to form line-type, ink jet head 3, and, therefore, even if a nozzle failure occurs, it suffices to replace only head unit 2 to which the defective nozzle belongs, thereby improving yield. In each of head units 2, however, reinforcement plate 80 providing rigidity may project from flow path unit 4 along the conveying direction. This may become a factor in hindering a high-density arrangement of head units along the conveying direction. Nevertheless, reducing the projection length of the reinforcement plate 80 may reduce rigidity. Thus, in an embodiment of the liquid drop ejecting device according to the present invention, smaller-width portions 87 may be disposed at each end of the reinforcement plate 80 in the nozzle arrangement direction, as well as larger-width portion 88 of greater width in the conveying direction than each of smaller-width portions 87, and smaller-width portion 87 of adjacent reinforcement plates 80 may be brought into mutual contact, so that, while maintaining the rigidity, the arrangement density of head units in the conveying direction may be enhanced without an undesirable increase in the size of the printer.

By positioning larger-width portion 88 to overlap a portion of liquid drop ejecting surface 7 in the main scanning direction, which especially requires rigidity in order to be secured, flow path unit 4 may be reinforced reliably while arranging head units 2 at a high density in the conveying direction. Furthermore, because larger-width portion 88 may project toward dead spaces of housing 6 created when the head units 2 are arranged in a staggered configuration, and, thus, may not undesirably increase printer size.

Moreover, because the plurality of ink supply ports 18 may be disposed at positions that overlap smaller-width portions 87 in the main scanning direction and that overlap ink ejecting surfaces 7 in the conveying direction, these ink supply ports 18 come to be located in dead spaces formed when the head units 2 are arranged in a staggered configuration, which may result in a size reduction of the printer.

Figure 8:
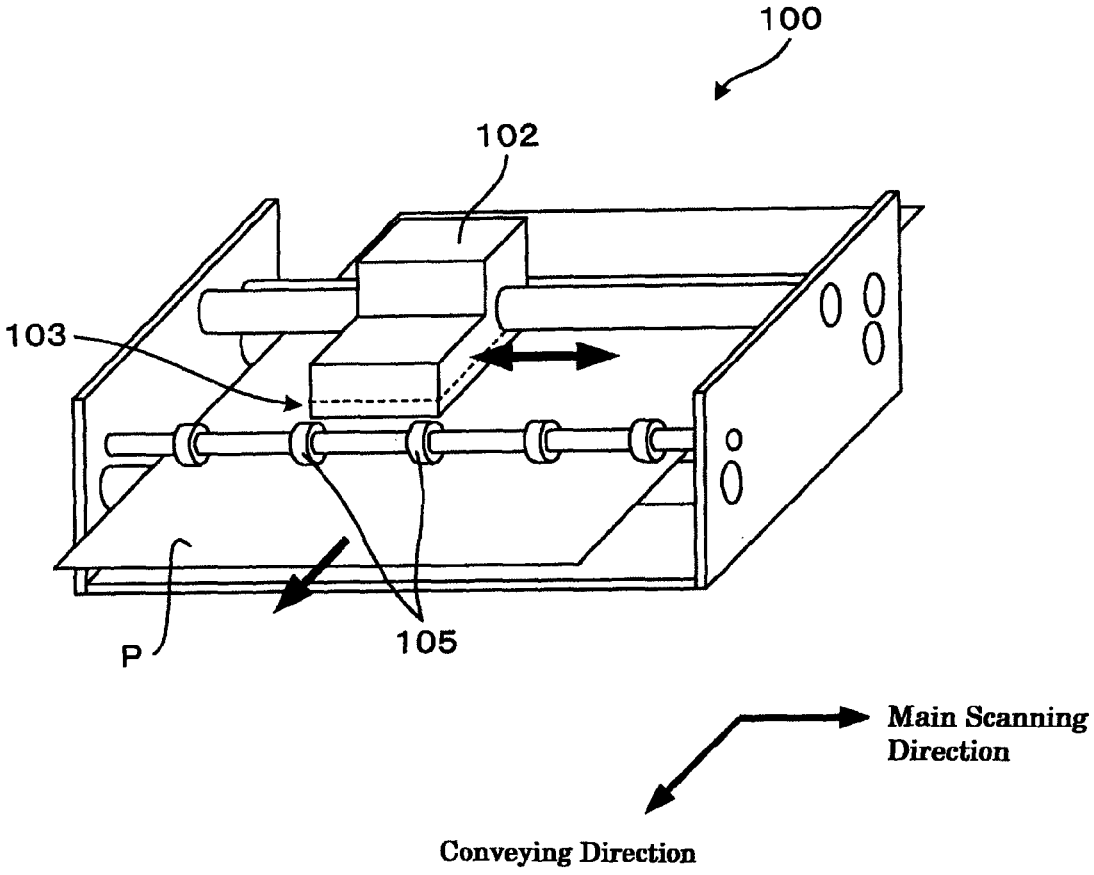
FIG. 8 is a perspective view of an ink jet printer apparatus equipped with a serial-type ink jet head.
Figure 9:
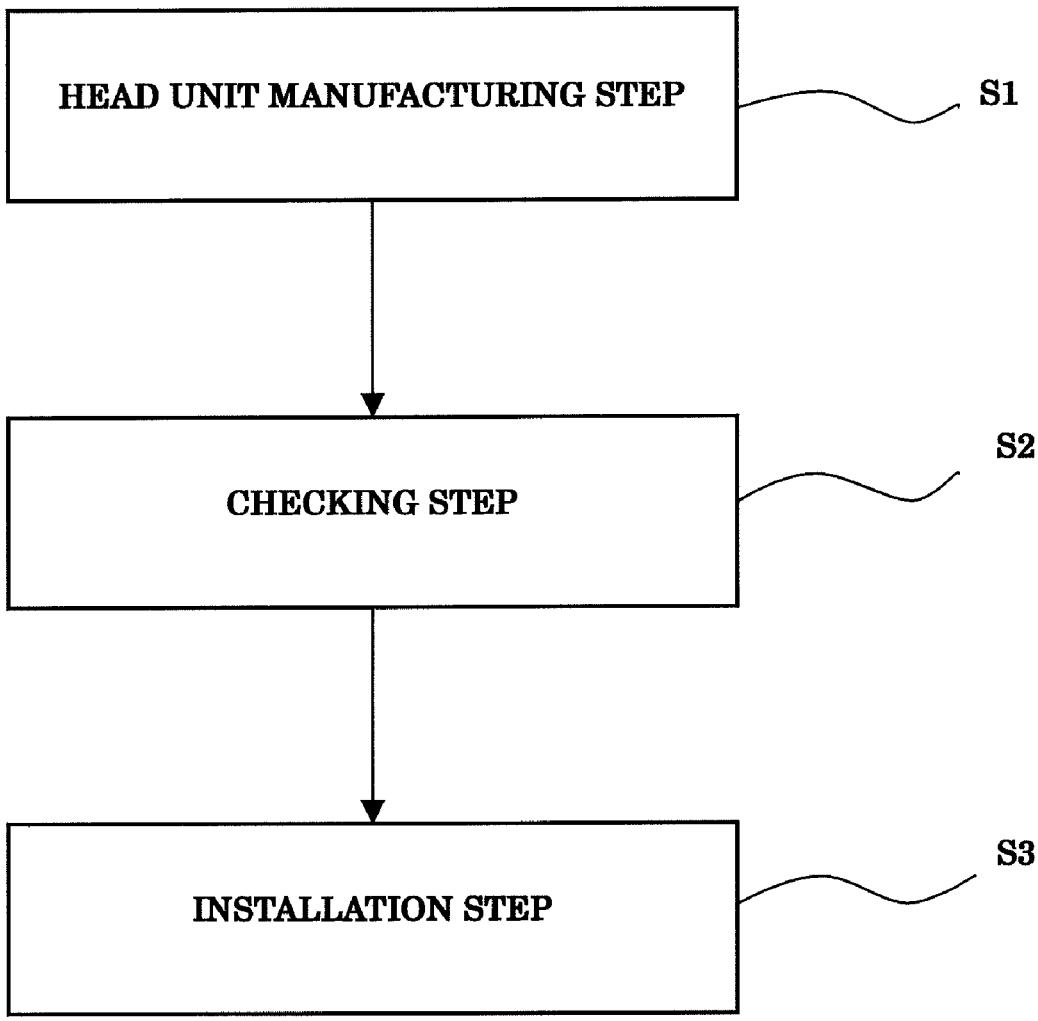
FIG. 9 is a flow chart regarding the method of manufacturing the ink jet printer.

Head unit 2 also may be used as a single piece for an ink jet printer equipped with a serial-type ink jet head, without combining a plurality of head units 2. As shown in FIG. 8, ink jet printer 100 may include a carriage 102 that is movable in the scanning direction having a serial-type inkjet head 103 configured to eject ink onto recording paper P. Conveying roller 5 may convey recording paper P in the conveying direction, as shown by the arrow. Ink jet printer 100 may be configured to cause ink jet head 103 to eject ink onto recording paper P while moving the ink jet head 103 along with carriage 102, and simultaneously, to cause the conveying roller 5 to convey recording paper P in the conveying direction, thereby recording desired images or letters onto recording paper P.

Serial-type ink jet head 103 is fixed to carriage 102 via a housing, such that reinforcement plate 80 may be mounted to the housing in such a way that the nozzle row direction of flow path unit 4 provided in the head unit 2 extends along the conveying direction. Thus, the same flow path unit 4 provided in line-type, ink jet head 3 also may be used in serial-type, ink jet head 103. Accordingly, reinforcement plate 80 also may be used in flow path unit 4 of either line-type ink jet head 3 or serial-type ink jet head 103. In addition, because flow path unit 4 may include nozzle rows 21 capable of ejecting color inks of black, yellow, cyan, and magenta, respectively, flow path unit 4 also may be used as head unit 2 for serial-type ink jet head 103 capable of ejecting a plurality of kinds of inks.

A method for manufacturing a liquid drop ejecting device according to one embodiment of the invention is described below. Flow path unit 4 may be formed with cavity plate 10, base plate 11, and manifold plate 12, each of which may include a hole formed therein for defining discrete ink flow path 22 including pressure chamber 14 and manifold flow path 17. Because plates 10-12 are made of metal material, holes forming discrete ink flow path 22 may be easily formed by etching.

Diaphragm 34, cavity plate 10, base plate 11, and manifold plate 12 may be stacked and joined to one another, for example, by mental diffusion bonding, such that the stacked plates are pressurized while heated up to a predetermined temperature of about 1000° C. or higher. Alternatively, the stacked plates may be joined with a ceramic adhesive having a high heat resistance.

Next, across opposite regions to the plurality of pressure chambers 14, piezoelectric layer 31 may be formed continuously on the top surface of diaphragm 34. Piezoelectric layer 31 may be formed by accumulating particles of a piezoelectric material on the top surface of diaphragm 34. For this purpose, for example, an aerosol deposition (AD) method, wherein aerosol composed of the particles and carrier gas is ejected onto a base material to accumulate the particles, a chemical vapor deposition (CVD) method or a sputtering method may be used. Alternatively, piezoelectric layer 31 may be formed by adhering a piezoelectric sheet, obtained by firing a green sheet, on the top surface of diaphragm 34.

In regions opposite to the plurality of pressure chambers 14, on the top surface of diaphragm 34 covered with piezoelectric layer 31, a plurality of respective discrete electrodes 32 may be formed. In addition, a plurality of wiring lines (not shown) extending from the plurality of respective discrete electrodes 32 may be formed on the top surface of diaphragm 34. The plurality of discrete electrodes 32 and the plurality of wiring lines then may be formed at once by screen printing, a deposition method, a sputtering method, or any other suitable process known in the art.

Next, nozzle plate 13, which may be formed of composite resin, may be joined to the bottom surface of manifold plate 12 with an adhesive or the like, thus completing the manufacturing of ink jet head 3. Then, at head unit manufacturing step S1 of FIG. 9, piezoelectric actuator 50 may be positioned in the opening 81 of reinforcement plate 80, and the top surface of cavity plate 10 and the bottom surface of reinforcement plate 80 are joined to each other with an adhesive or the like, to form head unit 2. Opening 81 of reinforcement plate 80 then may be formed by press work or the like.

At checking step S2, ink may be ejected from nozzle 20 of flow path unit 4 of head unit 2 checked to determine whether its ink ejection performance is normal, for example, whether there is no ejection failure due to nozzle clogging or whether ink is ejected from a desired ejection position of the nozzle 20 within a predetermined range. In this way, by supplying flow path unit 4 with reinforcement plate 80 and checking head unit 2 with its rigidity maintained, the ink ejection performance may be determined correctly without concern about warp of flow path unit 4 due to the pressure when ink is ejected from nozzle 20.

Next, at installation step S3, head units 2 that have been determined to be acceptable in ink ejection performance are arranged, so that each of their larger-width portion 88 and smaller-width portions 87 are arranged in the main scanning direction, and after flow path unit 4 has been positioned, openings 6*a* are formed in a staggered configuration. Openings 6*a* may be arranged in two rows along the main scanning direction so that head units 2 disposed in the two rows partially overlap one another in the main scanning direction and the distance between nozzles becomes uniform, upon which the head units 2 may be installed, and reinforcement plates 80 and housing 6 are fixed to each other with an adhesive or the like. Then, the adhesive may be injected into end faces where installed head units 2 are in contact with each other, to join adjacent head units 2 to each other. Thereafter, line-type, ink jet head 3, which has been manufactured by installing the plurality of head units 2 to housing 6, may be mounted to the casing of ink jet printer 1.

According to the above-described manufacturing method for ink jet printer 1, the density of head units 2 may be increased in the conveying direction while ensuring their rigidity, by providing at least one smaller-width portion 87 at one end of reinforcement plate 80 in the nozzle arrangement direction, and providing larger-width portion 88 greater in the width than the smaller-width portion 87 at another portion of reinforcement member so as to bring smaller-width 87 portion into contact with an adjacent reinforcement plate 80. Further, in this way, by installing head units 2 alone after having checked whether the liquid drop ejecting performances of the nozzles of the manufactured head units are acceptable, a manufacturing process time may be shortened.

Figure 10:
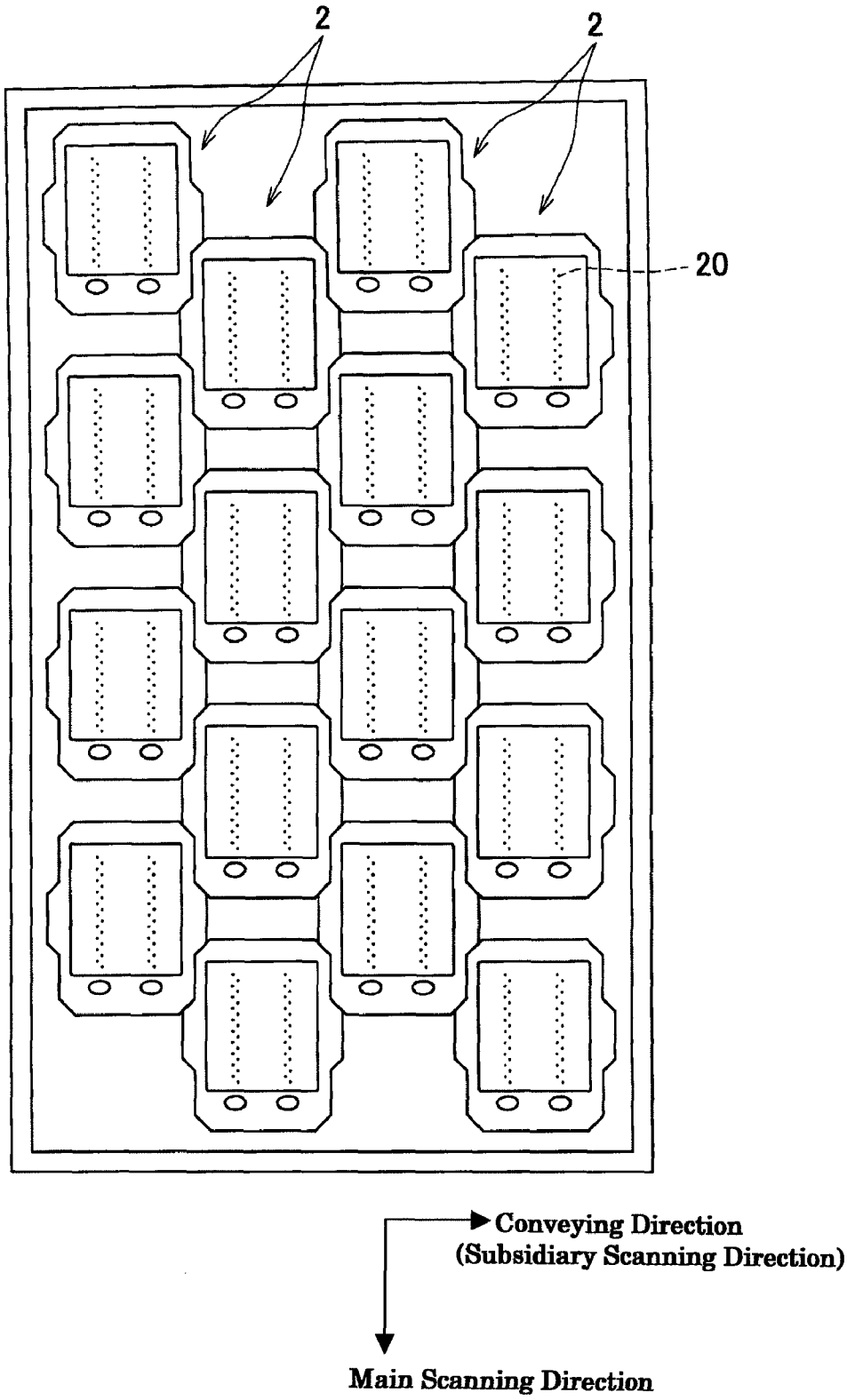
FIG. 10 is a plan view of an ink jet head wherein head units are arranged in four rows, as viewed from above.

FIG. 10 shows another embodiment of the invention, whereby head units 2 may be arranged in four rows along the main scanning direction in a staggered configuration. In this embodiment, alternating rows of head units 2 may deviate from each other by a half pitch in the main scanning direction using an adjustment margin. This may allow printing resolution to be doubled. When the density of head units 2 may increase in the conveying direction in such a way, the invention may produce an effect of reducing the printer size.

Figure 11:
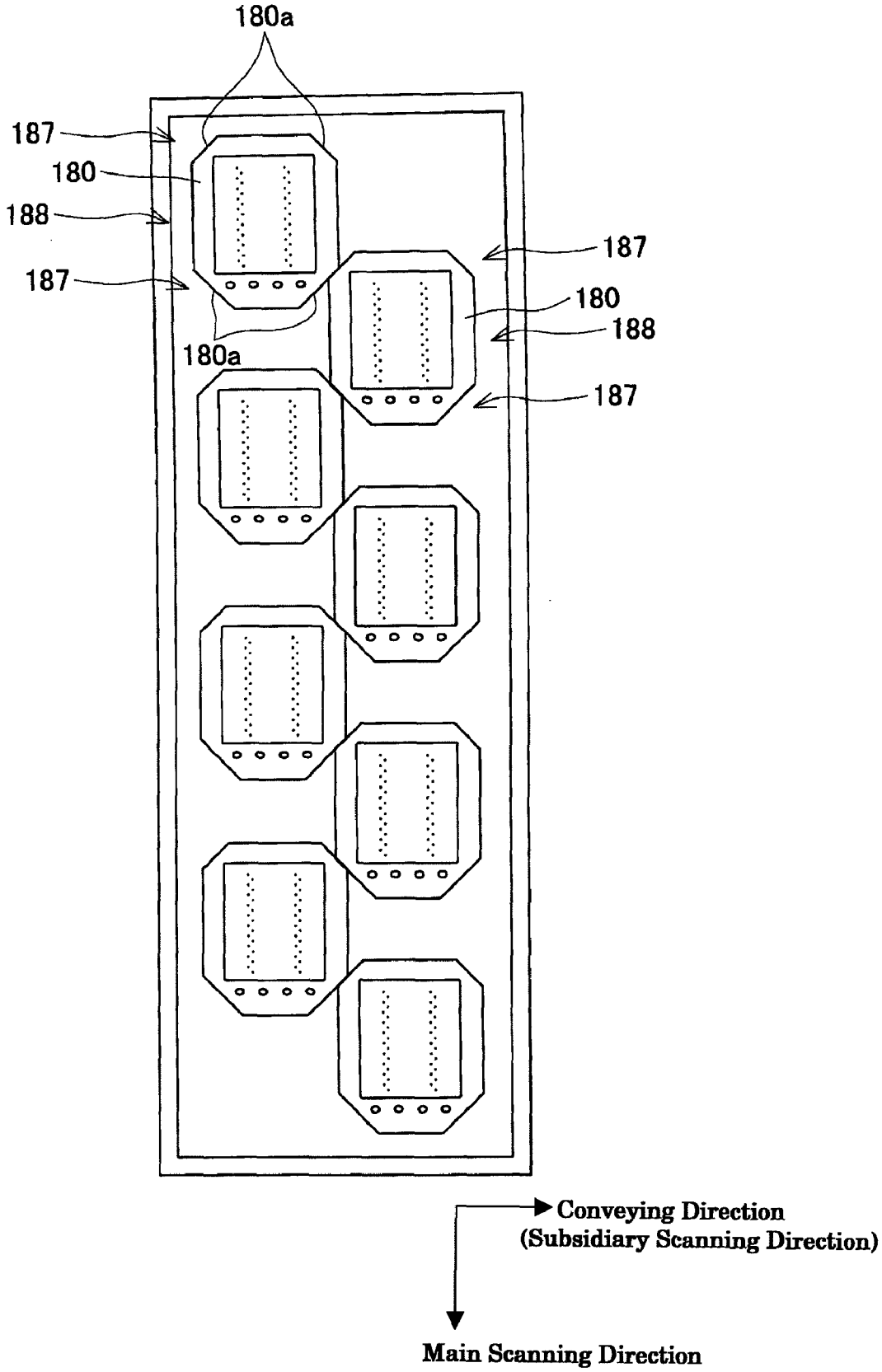
FIG. 11 is a plan view of an ink jet head including octagon-shaped reinforcement members, as viewed from above.

The reinforcement plate may have any shape as long at least one smaller-width portion contacts an adjacent reinforcement plate 180, and a larger-width portion that is larger in the widthwise dimension than the smaller-width portion. For example, as shown in FIG. 11 in yet another embodiment of the invention, reinforcement plate 180 may assume a shape having comparatively large corner portions that are chamfered, such as, for example, an octagon. Consequently, regions that overlap oblique lines 180*a* of reinforcement plate 180 in the main scanning direction may be smaller-width portions 187, and the other region may be larger-width portion 188. End faces forming oblique lines 180*a* of adjacent reinforcement plates 180 may be in contact with each other. In this manner, adjacent end faces may not include end faces forming sides along the main scanning direction, i.e., the nozzle arrangement direction.

Figure 12:
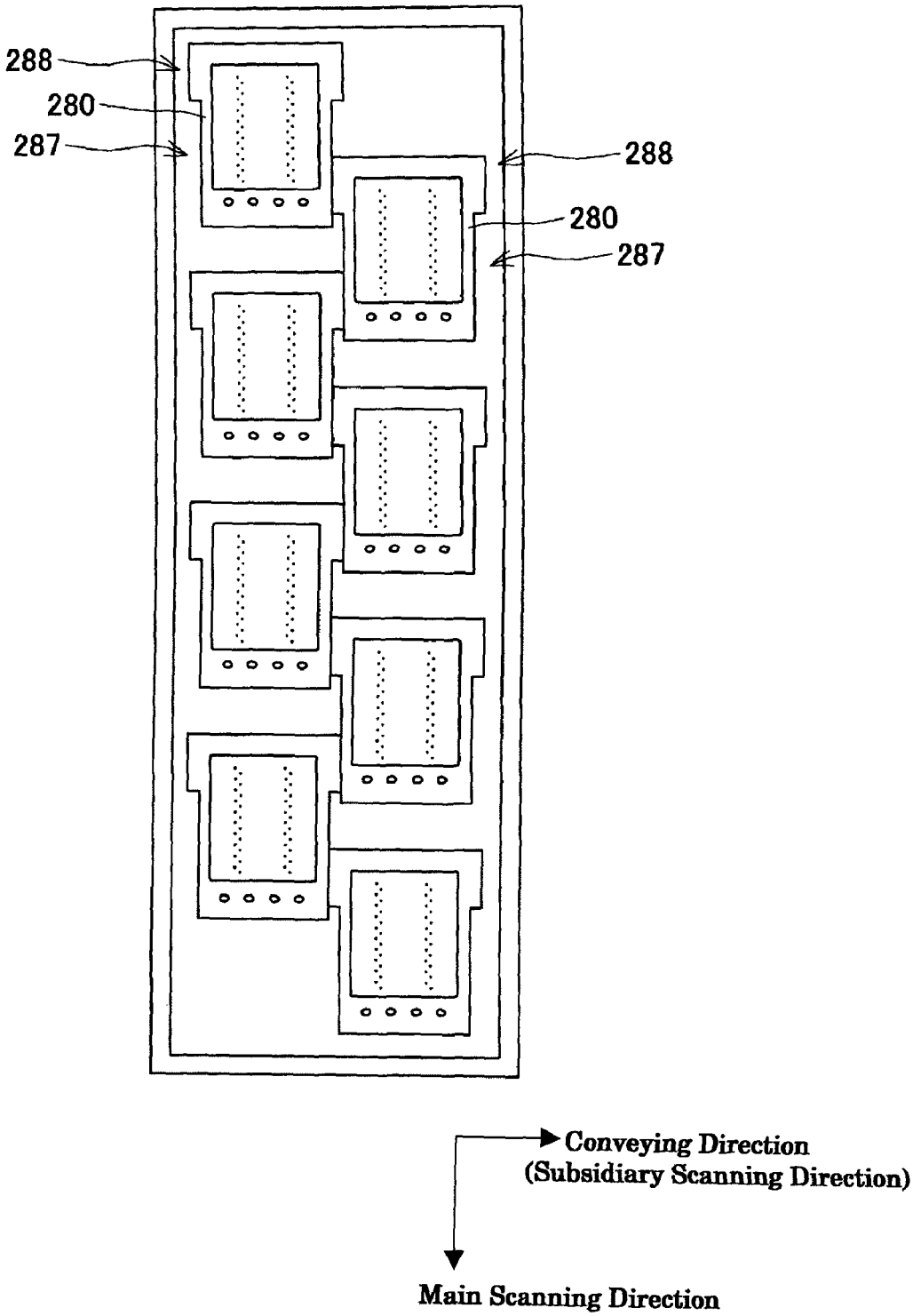
FIG. 12 is a plan view of an ink jet head in another embodiment of the present invention, as viewed from above.

FIG. 12 shows yet another embodiment of the invention, in which one end portion of a reinforcement plate 280 may be a larger-width portion 288, and the other end portion may be a smaller-width portion 287. In this embodiment an end face forming a side of the larger-width portion 288, may contact an end face forming a side of a smaller-width portion 287 of adjacent reinforcement plate 280 along the main scanning direction. Consequently, the present invention is not limited to the embodiment in which an end face of the smaller-width portion of one reinforcement plate may contact an end face of the smaller-width portion of another reinforcement plate.

Figure 13:
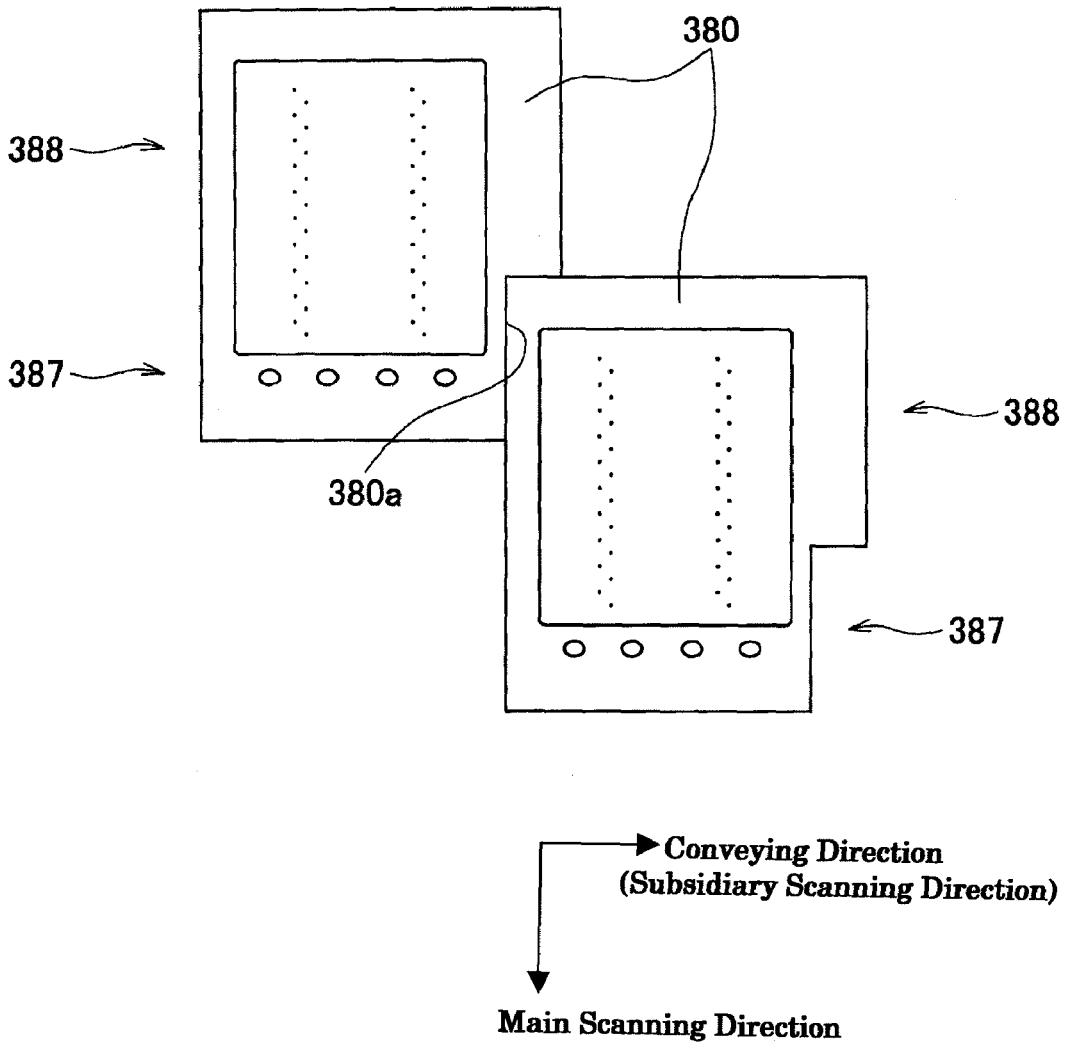
FIG. 13 is a plan view of head units in yet another embodiment of the present invention, as viewed from above.

FIG. 13 shows yet another embodiment of the invention, such that reinforcement plate 380 may include a notch 300*a* formed in a corner, a region overlapping notch 380*a* in the conveying direction may be a smaller-width portion 387, and the other region may be a larger-width portion 388. In this embodiment, an end face of larger-width portion 388 forming the corner of one reinforcement plate 380 may contact an end face of smaller-width portion 387 forming notch 380*a* of the other adjacent reinforcement plate 380.

In addition, smaller-width portions 87, 187, 287, and 387 of respective reinforcement plates 80, 180, 280, and 380 of one nozzle row may contact reinforcement plates 80, 180, 280, and 380 in respective adjacent rows in the conveying direction at their adjacent end faces. Nevertheless, as long as smaller-width portions 87, 187, 287, and 387 are the closest to the reinforcement plates in the respective adjacent rows in the conveying direction, these smaller-width portions may not necessarily contact each other. In order to make the distance between adjacent nozzles 20 along the main scanning direction in one nozzle row of one head unit 2, equal to the distance between adjacent nozzles 20 in another adjacent nozzle row in an adjacent head unit 2; positional adjustments with respect to reinforcement plates 80, 180, 280, and 380 in the main scanning direction may not be easily performed. Nevertheless, because an increased density of the head units 2 in the conveying direction is ensured, a reduced size printer may be provided.

Four nozzle rows 21 may be formed in flow path units 4 of one head unit 2 to allow color printing by four different color inks. When only black ink is used, as in the case of monochrome printing, only a single nozzle row 21 capable of ejecting black ink may be provided in flow path unit, 4 of head unit 2.

The above-described embodiments are illustrative of the application in which the present invention may be applied to an ink jet printer for ejecting ink onto recording paper P and recording an image or the like. Nevertheless, the present invention is not limited to such a usage. The present invention also may be suitable for other liquid drop ejecting devices that eject various kinds of liquids other than ink onto ejection targets, depending on intended usage.

While the invention has been described in connection with preferred embodiments, it will be understood by those of ordinary skill in the art that other variations and modifications of the preferred embodiments described above may be made without departing from the scope of the invention. Other embodiments will be apparent to those skilled in the art from a consideration of the specification or practice of the invention disclosed herein. It is intended that the specification and the described embodiments only are considered as exemplary embodiment of the invention, with the true scope of the invention being defined by the following claims.

What is claimed is:

1. A liquid drop ejecting device comprising:

a first head unit row comprising a plurality of head units arranged along a particular direction, each head unit in the first head unit row comprises a first overlapping portion; and a second head unit row comprising a plurality of head units arranged along the particular direction, each head unit in the second head unit row comprises a second overlapping portion, the first head unit row is adjacent to the second head unit row;

wherein the first row head units are arranged in a staggered configuration relative to the second row head units, the first overlapping portion of each first row head unit overlaps the second overlapping portion of the adjacent second row head unit along the particular direction, and wherein each of the head units comprises:

a particular flow path structure comprising a liquid path including a plurality of nozzles that are equidistantly arranged along the particular direction; and a reinforcement member coupled to the particular flow path structure and substantially parallel to a liquid drop ejecting surface to which the plurality of nozzles are opened, the reinforcement member comprises:

a projecting portion extending in a further direction perpendicular to the particular direction, the projecting portion forming a larger-width portion of a first width, the larger-width portion including a first end face extending along the particular direction; and at least one smaller-width portion of a second width adjacent to the larger-width portion along the particular direction, the at least one smaller-width portion including a second end face, and wherein the first width is greater than the second width along the further direction, and wherein the first overlapping portions comprise the projecting portions of the plurality of first row head units; and wherein each of the plurality of first row head units is arranged, such that a portion of the second end face of the first row head unit is positioned closer to the first end face and the second end face of the adjacent second row head unit than the corresponding first end face of the first row head unit.

2. The ink jet head according to claim 1, further comprising:

a first manifold flow path configured to supply a first liquid to the nozzles of the plurality of head units in the first head unit row; and and a second manifold flow path configured to supply a second liquid, to the nozzles of the plurality of head units in the second head unit row.

3. The liquid drop ejecting device according to claim 2, the particular flow path structure further comprises:

a first liquid supply port in fluid communication with the first manifold flow path; and a second liquid supply port in fluid communication with the second manifold flow path, wherein the first supply port and second supply port overlap the at least one smaller-width portion of the particular flow path structure along the particular direction, and are aligned with the liquid drop ejecting surface along the further direction.

4. The liquid drop ejecting device according to claim 1, wherein the liquid drop ejecting surface of the particular flow path structure overlaps the larger-width portion of the reinforcement member along the further direction.

5. The liquid drop ejecting device according to claim 1, wherein the at least one second end face extends along the particular direction parallel to the first end face, and wherein the second end faces of the first row head units are facing the second end faces of the adjacent second row head units in the further direction, and wherein the second end faces of the first row head units contact the adjacent second end faces of the second row head units.

6. The liquid drop ejecting device according to claim 5, wherein a boundary portion between the at least one smaller-width portion and the larger-width portion of the reinforcement member forms an obtuse angle relative to the second end face.

7. The liquid drop ejecting device according to claim 6, wherein the boundary portion of the reinforcement member comprises a bent-shaped end face between the first end face and the second end face, wherein the at least one smaller-width portion of the second row head units comprises a third end face forming the obtuse angle relative to the second end face of the second row units, and wherein each of the bent-shaped end faces of the first row head units contacts the third end face of the adjacent second row head unit and the first row head units are joined to the adjacent second row head units by adhesive.

8. The liquid drop ejecting device according to claim 7, wherein the adhesive is a light-curable resin.

9. The liquid drop ejecting device according to claim 1, wherein the liquid drop ejecting device is a serial-type liquid drop ejecting device mounted on a carriage movable in the particular direction, the serial-type liquid drop ejecting device configured to eject liquid drops when moved by the carriage in the particular direction.

10. The liquid drop ejecting device according to claim 1, further comprising:

a third head unit row comprising a plurality of head units arranged along a particular direction, each head unit in the third head unit row comprises a third overlapping portion; and a fourth head unit row comprising a plurality of head units arranged along the particular direction, each head unit in the fourth head unit row comprises a second overlapping portion, the third head unit row is adjacent to the second head unit row and the fourth head unit row, wherein the first row head units and the third row head unit row are arranged in a staggered configuration relative to the second row head units and the fourth row head units, the third overlapping portion of each third row head unit overlaps the adjacent fourth overlapping portion of each fourth row head unit along the particular direction, and wherein third overlapping portions comprise the projecting portions of the plurality of third row head units, and wherein each of the plurality of third row head units is arranged, such that a portion of the second end face of each third row head unit is closer to the first end face and the second end face of each adjacent fourth row head unit than the first end face of each third row head unit.

11. A method for manufacturing a liquid drop ejecting device, the method comprising the steps of:

manufacturing a head unit including a flow path structure, comprising:

providing a liquid path including a plurality of nozzles that are equidistantly arranged along a particular direction, the nozzles opening to a liquid drop ejecting surface;

providing a reinforcement member having a projecting portion extending in a further direction perpendicular to the particular direction, the projecting portion forming a larger-width portion of a first width, the larger-width portion including a first end face extending along the particular direction, the reinforcement member having at least one smaller-width portion of a second width adjacent to the larger-width portion along the particular direction, the at least one smaller-width portion including a second end face, and the first width is greater than the second width along the further direction; and coupling the reinforcement member to the flow path structure so as to project from both sides the head units in the further direction and parallel with the a liquid drop ejecting surface; and installing a plurality of the head units in a first head unit row and a second head unit row extending along the particular direction, the first row head units are installed in a staggered configuration relative to the second row head units whereby the first row head units partially overlap the second row head units along the particular direction, and the first head unit row is adjacent to the second head unit row in the further direction, wherein the step of installing comprises bringing the second end face of each of the first row head units into contact with the first end face or second end face of an adjacent second row head unit in the further direction.

12. The method for manufacturing a liquid drop ejecting device according to claim 10, the method further comprising the steps of:

checking the liquid drop ejecting performance of the nozzles in the flow path structure is normal after the step of coupling the reinforcement member to the flow path structure, and determining whether liquid drop ejecting performance of the nozzles in the flow path structure is within predetermined parameters after the checking step, wherein the installing step is performed after determining the liquid drop ejecting performance is within predetermined parameters in the determining step.

* * * * *